US005138815A

United States Patent [19]

Groschen, Jr.

[11] Patent Number: 5,138,815

[45] Date of Patent: Aug. 18, 1992

[54] MICROPROCESSOR CONTROLLED SCR MOTOR DRIVES FOR WRAPPING MACHINE

[75] Inventor: Paul L. Groschen, Jr., White Bear Lake, Minn.

[73] Assignee: Doboy Packaging Machinery, Inc., New Richmond, Wis.

[21] Appl. No.: 791,021

[22] Filed: Nov. 12, 1991

[51] Int. Cl.[5] ..... B65B 9/06; B65B 57/00

[52] U.S. Cl. ..... 53/55; 53/389.4; 53/550

[58] Field of Search ..... 53/64, 55, 52, 77, 550, 53/548, 450, 389.4, 389.3, 389.2

[56] References Cited

U.S. PATENT DOCUMENTS

| | | | |
|---|---|---|---|
| 4,506,488 | 3/1985 | Matt et al. | 53/55 |
| 4,574,566 | 3/1986 | Eaves et al. | 53/55 X |
| 4,712,357 | 12/1987 | Crawford et al. | 53/55 X |
| 4,726,168 | 2/1988 | Seko | 53/550 X |
| 4,807,420 | 2/1989 | Barker | 53/550 X |
| 4,909,018 | 3/1990 | Yamamoto | 53/55 X |
| 4,924,657 | 5/1990 | Berti et al. | 53/550 X |

FOREIGN PATENT DOCUMENTS 2204551 11/1988 United Kingdom .

*Primary Examiner*—James F. Coan

*Attorney, Agent, or Firm*—Haugen and Nikolai

[57] ABSTRACT

A microprocessor controlled wrapping machine including a separate SCR drive driving a corresponding permanent magnet motor, wherein an incremental optical encoder is coupled with each permanent magnet motor to provide a feedback signal indicative of motor position to a microprocessor. Both a main motor, which drives the infeed conveyor and the cutting head assembly, and a finwheel motor are used in combination with the SCR drive and an incremental optical encoder to provide a low cost alternative to a servo amplifier-controlled motor drive. Both the finwheel motor and the main motor are independently controlled from one another as a function of an oscillator, which forms a portion of the microprocessor circuit, and as a function of input switches and the respective feedback signal provided by the respective incremental optical encoder. The present invention provides a low cost alternative to wrapping machines incorporating expensive servo amplifier-controleld motor drives. Using an incremental optical encoder, the associated motor speed can be precisely controlled.

16 Claims, 7 Drawing Sheets

MOTOR CONTROL ALGORITHM

ACCELERATION/DEACCELERATION PROFILE

STOPPING ALGORITHM

MICROPROCESSOR CONTROLLED SCR MOTOR DRIVES FOR WRAPPING MACHINE

BACKGROUND OF THE INVENTION

I. Field of the Invention

This invention relates generally to wrapping and packaging machines and, more particularly, to a horizontal wrapping machine utilizing a microprocessor-based control system having separate SCR drives driving separate permanent magnet drive motors which are controlled independently of one another.

II. Discussion of the Prior Art

In a horizontal wrapping machine, a continuous film of packaging material is supplied from a roll and drawn past a former which shapes the film into a continuous tube of packaging material. Products to be wrapped are supplied through the former into the tube of packaging material such that the products are spaced apart from one another in the tube. The opposed edges of the film of the tube are juxtaposed and longitudinally sealed, and the tube of packaging material is then cut and transversely sealed as each product, carried within the tube, passes through a sealing and cutting station. In this way, an individual sealed wrapping is formed about each product.

The film is formed in the former such that the lateral edges of the film, when the tube is formed, extend downwardly from the center of the film tube in a side-by-side relationship. One or more pairs of finwheels, rotating about vertical axes, engage opposite sides of the downwardly extending pair of film edges to drive the film toward the cutting and sealing station. At least one pair of finwheels in the finwheel assembly may be heated, serving to heat seal the downwardly extending film edges together to seal the tube of heat sealable film as they rotate to advance the film off its supply roll. Other so-called "cold seal film" do not need heat but, instead, use the pressure of one or more finwheel assembles to create the seal.

As the now-enclosed tube of film carrying products which are spaced apart from one another advances past the sealing and cutting station, opposed rotary cut/seal heads, one containing a knife member and the other an anvil, come into engagement with the film tube between each successive pair of products. The cut/seal head may also include heated members so as to seal the film as it is cut to thereby form individual sealed packages, each containing a non-wrapped product.

One typical horizontal wrapping machine as disclosed in U.S. Pat. No. 4,574,566, and assigned to the present applicant, teaches a horizontal wrapping machine having several individually controlled servo-controlled motor drives which are controlled in response to the measured film velocity. One motor is used to drive the product in-feed conveyor, others for the finwheel assemblies and yet another for the cut/seal head. Servo-controlled motor drives each have a closed-loop servo-control circuit including a motor which is driven by a summing amplifier. The summing amplifier receives as a feedback signal the actual motor velocity and receives as a control signal a desired motor velocity. While these servo-controlled motor drives are very well suited to be implemented in horizontal wrapping machines, they tend to be quite expensive. Basically, the high cost of the servo-controlled motor drives is justified by the quick response rate and the linearity of the motor speed in response to the control signal. Thus, quick start and stop times can be realized using servo-controlled motor drives.

Since horizontal wrapping machines require a substantial financial investment by a business, it is desirable to provide a low cost horizontal wrapping machine without sacrificing any of the major features of individually controlled motor drive wrapping machines, such as easy product changeover or the accurate control of package lengths Since horizontal wrapping machines are usually continuously used, the starting and stopping times of the machine are perhaps a less important consideration to the average business. Thus, a horizontal wrapping machine which utilizes motors which are less expensive, albeit having slower response times, is desirable in the industry to provide an affordable alternative to some of the more expensive high-performance horizontal wrapping machines currently available.

Motors, such as SCR wound permanent magnet motors, typically respond in a very linear manner to control signals, but have much slower response times as compared to DC servo motors. Further, permanent magnet motors do not inherently contain feedback control means to sense a precise motor speed in response to an input signal. Thus, using permanent magnet motors would require a discrete feedback means to monitor the actual speed of the motor in response to a particular control signal.

OBJECTS

It is accordingly an object of the present invention to provide a horizontal wrapping machine which is substantially less expensive than conventional horizontal wrapping machines implementing servo-controlled motor drives.

It is a further object of the present invention to provide a horizontal wrapping machine implementing less expensive motors without sacrificing major performance characteristics, such as easy product changeover, or the precision with which the motor speeds are controlled.

It is a further object of the present invention to provide a horizontal wrapping machine wherein each of the motor drives operates independently of the others.

SUMMARY OF THE INVENTION

The foregoing objects and advantages of the present invention are achieved by providing a horizontal wrapping machine, including permeane magnet motors driven by SCR drives, wherein each motor is coupled to an encoder for providing a feedback signal indicative of the motor position back to the controller. The wrapping machine includes a former for shaping a continuous flat film of packaging material drawn past the former into a continuous tube. A film drive, which is responsive to a film drive rate control signal, operates the finwheels to draw the continuous film of packaging material past the former and past a cutting and sealing station at a velocity which is dependant upon the film drive rae control signal. A film drive sensor senses the film drive and provides a first output indicative of a position of the first drive. A cutting and sealing drive, which is responsive to a product flow rate control signal, cuts and seals the continuous tube of packaging material as each product moves past the cutting and sealing station. An infeed drive mechanism feeds products to be packaged into the former and the continuous tube of packing material as a function of the cutting and sealing drive. A product flow sensor senses the cutting and sealing drive and provides a second output of the position of the cutting head drive. An input selector selects the product flow rate of the wrapping machine. A microprocessor-based circuit includes a clock and is coupled to and is responsive to the input selector. The microprocessor-based circuit provides the film drive rate control signal as a function of the clock, the input selector and the first output. The microprocessor circuit also provides the product flow rate control signal as a function of the clock, the input selector and the second output Thus, the film drive and the cutting head drive are responsive to respective control signals which are dependent upon a precisely occurring clock signal, the input selector, and the respective output from the respective sensor. Therefore, the position and velocity of the film drive and cutting head drive are independently controlled. The film drive sensor and the cutting head sensor each sense the position of the respective drive such that the microprocessor-based circuit can determine the velocity of the respective drive as a function of the output from the respective sensor and the clock, which is used to establish a time reference in conjunction with the change of position of the respective drive.

The clock preferably comprises an oscillator operating at a fixed frequency, such as the crystal-controlled oscillator cooperating with the microprocessor-based circuit. Thus, after a predetermined number of clock pulses, a time period is established which determines the velocity of the respective drive.

The wrapping machine also preferably includes a film drive position sensor for developing a first digital output indicative of instantaneous position of the film relative to a predetermined reference. A cutting head position sensor develops a second digital output indicative of the rotational position of the cutting head of the end seal station. The microprocessor-based circuit adjusts the film drive rate control signal as a function of the first digital output to adjust the velocity of the film drive. Coordination of the product being wrapped with the cutting head is provided by the infeed drive mechanism.

The film drive preferably comprises a first SCR motor drive circuit receiving the film drive rate control signal, and a first permanent magnet motor coupled and responsive to the output of the first SCR drive circuit. The cutting head drive preferably comprises a second SCR drive circuit which receives product flow rate control signal, and which drives a second permanent magnet motor. Thus, the respective SCR drives receive the respective control signals from the microprocessor-based circuit and controls the velocity of the respective permanent magnet motor. Both the film drive sensor and the cutting head sensor include a digital encoder for sensing the position of the respective drive. The encoder may typically be an incremental optical encoder providing a quadrature digital output signal to the microprocessor-based circuit, wherein a microprocessor computes the velocity of the respective permanent magnet motor as a function of the respective digital output and the clock. The respective encoder provides a closed-loop feedback signal from its associated drive to the microprocessor-based circuit such that the microprocessor circuit precisely monitors the velocity of the respective film drive permanent magnet motor and the cutting head drive second permanent magnet motor.

During acceleration of the film drive and cutting head drive from rest, the value of both the film drive rate control signal and the product infeed rate control signal are non-linear over time. This non-linear relationship, rather than linearly accelerating the respective drives, allows the speed of the respective drives to be precisely controlled since SCR wound permanent magnet motors with their corresponding SCR drives have a tendency to be sluggish in response to control signals attempting to accelerate them quickly. For instance, accelerating the drives using a control signal which is generally logarithmic with respect to time has been found suitable to maintain precise control of the respective drive while still allowing a reasonably short time to reach a steady-state velocity.

The wrapping machine also includes a discharge drive for removing packages from the cutting and sealing station but that drive does not require precise control. As already mentioned, the film drive preferably includes at least one pair of finwheels which is heated to cause sealing of the fins of the film package together along a longitudinal seam.

The foregoing features, objects, and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
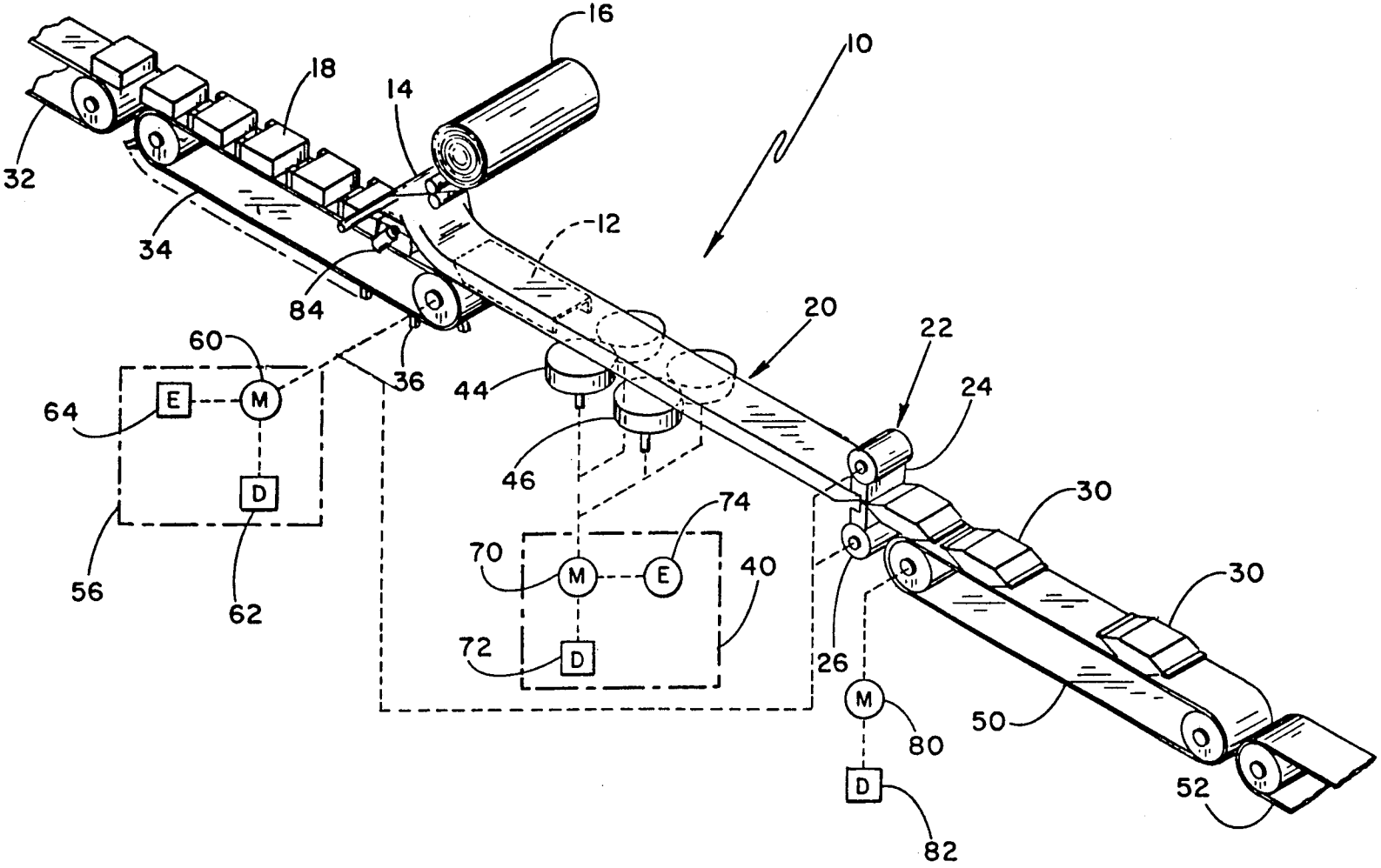
FIG. 1 is a perspective view of a horizontal wrapping machine according to the present invention.

A perspective view of a horizontal wrapping machine according to the present invention is illustrated in FIG. 1 and is generally labeled 10. Machine 10 includes a former 12 for shaping a continuous film 14 of packaging material which is drawn past the former 12 from a roll of sheet film 16, which may be printed or unprinted. Products 18 to be wrapped are fed into the former 12 and carried within a packaging film tube 20 formed by the former 12. The products 18 are carried within the film tube 20, spaced apart from one another, past a sealing and cutting station 22 at which a pair of opposed sealing and cutting heads 24 and 26 cut and seal the film tube 20 as each product 18 moves past the cutting and sealing station 22 to form discrete sealed product packages 30.

In order to supply products 18 to film former 12, products 18 are received from a suitable supply source conveyor 32 on an endless conveyor 34 termed the "infeed conveyor" and which is divided into a series of flights by a number of product pushers 36. Each product 18 is carried in a flight on conveyor 34 with its trailing end resting against pusher 36.

The products 18 are introduced into the interior of film tube 20 formed by former 12 by advancing products 18 into former 12. Each product 18 is then received on and carried along by the interior bottom surface of film tube 20. Film tube 20 is shown as being formed into a generally rectangular shape, having its two edge portions formed into downwardly extending strips (not shown). Film 14 is driven by a finwheel motor assembly 40 to advance film tube 20 toward cutting and sealing heads 24 and 26 by gripping the downwardly extending adjacent pair of film edges. To do this, finwheel assembly includes two pairs of opposed finwheels 44 and 46. Each finwheel in each pair of finwheels rotates in an opposite direction, firmly griping the film edges therebetween, moving the film tube 20 toward the cutting and sealing heads 24 and 26. One or both of the finwheels of each pair 44 and 46 may be heated to seal the edges of the film together to close the film tube 20.

The now-sealed tube 20 containing the spaced apart products 18 is advanced by the pairs of finwheels 44 and 46 past the cutting and sealing heads 24 and 26. The cutting and sealing heads 24 and 26 are rotated in opposite angular directions to meet and engage film tube 20 after each product 18 moves past the cutting and sealing station 22. The cutting and sealing heads 24 and 26, respectively, when in engagement with film tube 20, must move at substantially the same linear rate as film and co-act to compress film tube 20 together into a flattened condition.

Each of the cutting and sealing heads 24 and 26 may be heated and the compressed film tube 20 is sealed as it is cut, thereby enclosing each product 18 in an enclosed and sealed package 30. In order to cut the sealed film to produce discrete packages 30, upper head 24 contains a knife edge extending from its film-engaging surface. The lower cutting head 26 contains an anvil. The knife and anvil co-act to cut film tube 20 as it is sealed, all as is well known in the art.

Packages 30 are carried from the cutting and sealing station by a discharge conveyor 50, which operates at a slightly higher rate than the rate of travel of film tube 20. Packages 30 are then discharged onto a suitable receiving apparatus 52.

Additional technical description of a typical wrapping machine can be found in U.S. Pat. No. 4,574,566 assigned to the present applicant and incorporated herein by reference.

A main motor assembly 56 drives cutting heads and sealing heads 24 and 26 and includes a motor 60 which is coupled to a drive shaft of the cutting head assembly 22 (not shown). Main motor 60 also drives infeed conveyor 34 directly via gears or belts (not shown). As shall be described in more detail hereafter, motor 60 is preferably a relatively low-cost permanent magnet motor and is driven by an SCR drive 62 which is controlled by an analog control signal provided by a microprocessor-based circuit. An incremental optical encoder 64 is coupled to motor 60 by a drive belt and senses the angular position of the shaft of motor 60 at any given moment. Encoder 64 provides a feedback signal to the control circuit, as will be described shortly, which is used to calculate true velocity of motor 60 and cutting and sealing heads 24 and 26. Similarly, a permanent magnet motor 70 is coupled to a drive shaft of each of the finwheels of both pairs 44 and 46. An SCR drive 72 also receives a separate analog control signal from the microprocessor-based circuit, as will be described shortly, and drives permanent magnet motor 70 in response to the control signal. An incremental optical encoder 74 is physically coupled to motor 70, via a drive belt, to sense the position of motor 70 at any given moment.

The microprocessor-based circuit separately determines the velocity of both motors 60 and 70 by comparing the feedback signal indicative of position as provided by the respective encoder 64 and 74 over a given time period which is determined by sensing an oscillator running at a fixed frequency. Cutting head or main motor 60 and finwheel motor 70 are independently controlled by the microprocessor-based circuit; however, the speeds of respective motors 60 and 70 are controlled at a rate such that the velocity of cutting and sealing heads 24 and 26 is identical to the velocity of film tube 20.

A permanent magnet motor 80 is coupled to the drive shaft of discharge conveyor belt 50 and is driven by an SCR drive 82 which is responsive to the microprocessor-based circuit similar to motors 60 and 70. Rather than providing an encoder to sense the velocity of motor 80, a fine adjustment, such as a potentiometer, is used to manually adjust the velocity of motor 80 by hand. The speed of motor 80 is adjusted such that the velocity of take-up conveyor 50 is slightly greater than the velocity of film tube 20 to snap packages 30 apart from one another after passing the cutting and sealing station 22.

An optical sensor 84 is adapted to sense uniformly spaced markings on the film referred to as "eye spots" to establish a reference on film 14. Sensor 84 provides a digital output signal which is synchronized by the microprocessor-based circuit with a digital output signal provided by a proximity sensor on cutting head 24 to ensure cutting station 22 cuts the film tube 20 at the correct location. The speed of finwheel motor 70 is adjusted by the microprocessor-based circuit to remove any alignment errors.

Figure 2:
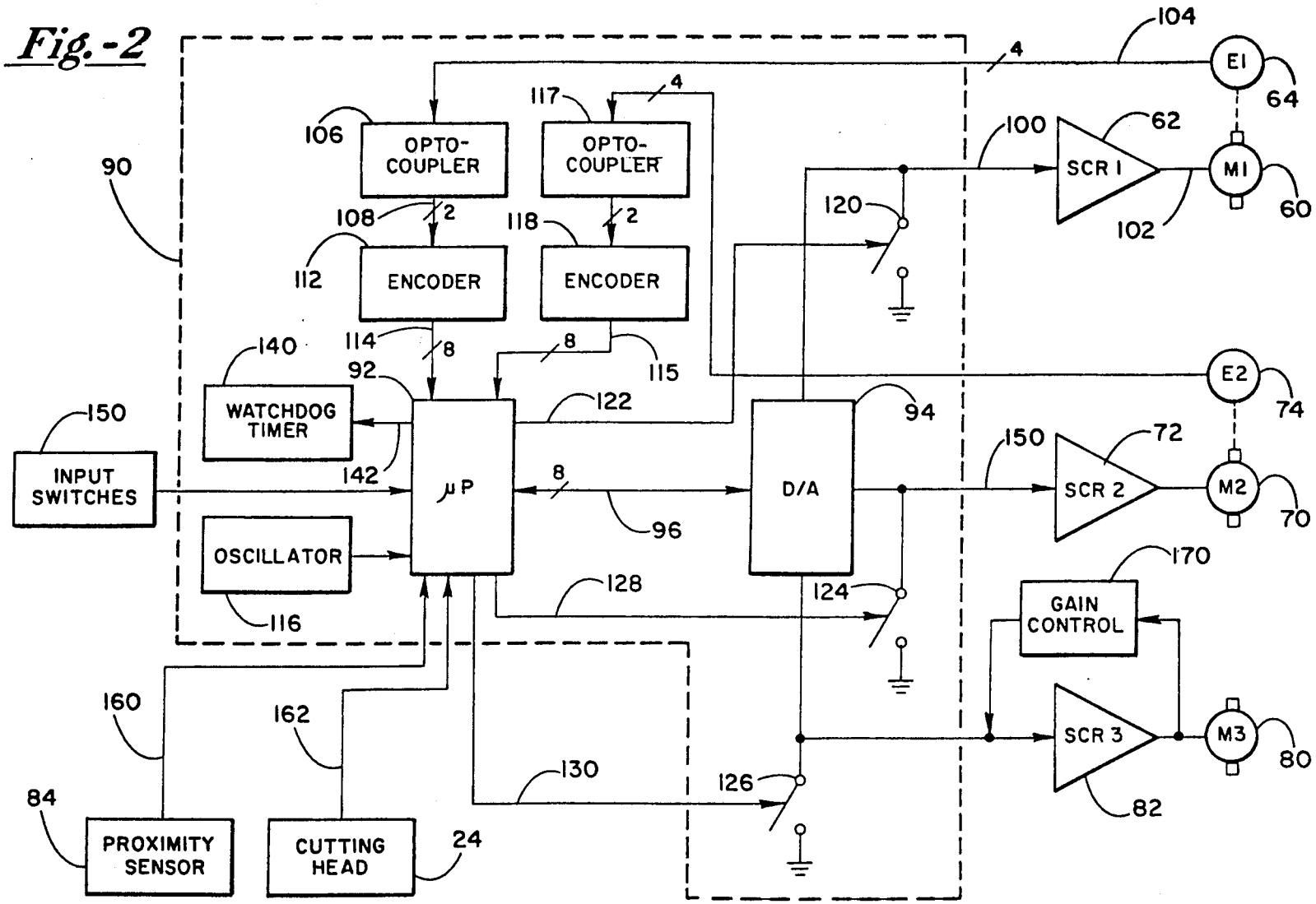
FIG. 2 is a functional block diagram of the wrapping machine according to the present invention.

Referring now to FIG. 2, a functional block diagram of the horizontal wrapping machine according to the present invention is illustrated. Microprocessor-based circuit 90 includes an eight-bit microprocessor 92, such as an Intel 8051, which executes a motor control algorithm as will be described in the software description shortly. Microprocessor 92 operatively communicates, via a digital-to-analog converter 94, to interactively communicate with each SCR drive 62, 72 and 82 to control the speeds of motors 60, 70 and 80.

Microprocessor 92 controls the speed of motor 60 by generating a digital word on a parallel bus 96 which is received by D/A converter 94 and converted to a 0–10VDC analog signal and outputted onto control line 100. The analog control signal is routed, via control line 100, to SCR drive 62, such as a model PCM23000A manufactured by Minarik Electric Company of Glendale, California. SCR drive 62 converts the 0–10 volt DC signal to a 0–90 volt DC signal, which is outputted on control line 102. The output signal provided on control line 102 by SCR drive 62 is proportional to the input signal provided on line 100 from D/A converter 94. Motor 60 receives the analog input signal via control line 102 and operates at a speed which is proportional to the input signal. Motor 60, as graphically illustrated in FIG. 1, is considered the main motor since it drives both the infeed conveyor belt 34 and the cutting head at sealing station 22. A one-horsepower permanent magnet DC motor, such as a model CDP3455 manufactured by Baldor Electric Company of Fort Smith, Arkansas, has been found suitable with the present invention. The incremental optical encoder 64, such as a model H20 manufactured by BEI Motion Systems Company of Galeta, California, is directly driven by a belt from motor 60. Encoder 64 provides a quadrature phase digital output signal which is indicative of the sensed motor position, not the velocity, to feedback line 104. Encoder 64 has a resolution of 600 pulses per turn, and thus provides a very accurate position measurement. An opto-coupler 106 is coupled to line 104 and forms a portion of control circuit 90. It interfaces the quadrature output signal of encoder 64 to control line 108 which is routed to a quadrature encoder chip 112. Opto-coupler 106 provides noise reduction and isolates the grounds between encoder 64 and the microprocessor-based circuit 90. Quadrature encoder chip 112 encodes the digital signal on line 108 to an eight-bit parallel digital signal on control line 114, which is routed back to microprocessor 92.

Microprocessor 92 calculates the velocity of motor 60 by generating an interrupt periodically. The interrupt is generated every time a fixed number of clock cycles has elapsed from a known fixed frequency oscillator 116 which is the oscillator for microprocessor 92. After determining the change of position of motor 60 as sensed by encoder 64 during this time period, the velocity of motor 60 can be determined by comparing the change of position of motor 60 during the time period between successive interrupts. Thus, if the microprocessor 92 determines motor 60 is operating at a speed faster or slower than the speed instructed via the D/A converter 94 and the SCR drive 62, the microprocessor 92 can adjust the control signal provided on line 100 via D/A converter 94 to adjust the speed of motor 60 accordingly.

The speed of finwheel motor 70 can be controlled and monitored by microprocessor 92 in a manner similar to motor 60 by SCR drive 72, encoder 74, an opto-coupler 117 and an encoder chip 118. Motor 70 preferably comprises a one-quarter horsepower permanent magnet motor, such as a model GPP7451 also manufactured by Baldor Electric Company. SCR drive 72 preferably comprises a model PCM21000A drive manufactured by Minarik Electric Company. The algorithm of this adjustment and speed control will be discussed shortly in the software section.

Microprocessor 92 can also disable motor 60 altogether by disabling relay 120 which shorts the input of SCR drive 62 to ground, thus providing a zero volt signal to motor 60 causing motor 60 to stop. Similarly, motors 70 and 80 can also be disabled by disabling respective relays 124 and 126 via control lines 128 and 130, respectively.

Microprocessor 92 continuously outputs a pulse to watchdog timer 140 via output line 142. The watchdog timer is a commercially available circuit and well known in the art. Digital signals are continuously provided on line 142 as long as software is operating properly. If these digital signals cease to be provided on line 142 for a predetermined period of time, it is an indication of system malfunction and watchdog timer 140 92 shuts down the wrapping machine by disabling each of motors 60, 70 and 80.

Microprocessor 92 senses a set of thumb-wheel input switches 150 which are manually set to indicate the number of packages per minute to be wrapped, and the package length of each package. The desired velocity of the cutting head assembly 22 and continuous film tube 20 can be determined by microprocessor 92 by knowing the quantity of packages to be packaged per minute along with the package length. The appropriate control signals are generated by microprocessor 92 via control line 100 and control line 150 communicating with SCR drive 62 and SCR drive 72, respectively, based on the cutting head assembly 22 velocity and the film tube 20 velocity, as well as the known respective gear ratios between motor 70 and motor 60. As shown, the operator manually adjusts input switches 150 to determine the input parameters to the wrapping machine, wherein microprocessor 92 executes the control algorithm to generate appropriate signals via control lines 100 and 150 to command motors 60 and 70 to operate at an appropriate speed. Proximity sensor 84, as illustrated in FIG. 1, which is an optical sensor, senses the uniformly spaced eye spots on the edge of film 12 and generates a transition on a digital signal on line 160 at the moment a marking is sensed. Cutting head 24 also generates a digital output signal on line 162 every time cutting head 24 passes a predetermined position. Microprocessor 92 senses the digital signals provided on lines 160 and 162 and attempts to synchronize them by adjusting the speed of motor 70 using corresponding commands via control line 150. For instance, if the digital signal received from the proximity sensor 84 is received slightly prior to the digital signal received from cutting head 24 via output line 162, microprocessor 92 sends a command via control line 150 to SCR drive 72 which is slightly greater than the previous command to thereby slightly increase the speed of finwheel motor 70 until the output signals on output lines 160 and 162 are received by microprocessor 92 synchronously.

As noted previously, discharge motor 80 is driven by SCR drive 82 wherein the speed is manually adjusted by adjusting a feedback gain control potentiometer 170 to ensure discharge motor 80 drives take-up conveyor 50 at a velocity slightly greater than the speed of film tube 20. SCR drive 82 is identical to SCR drive 72, and motor 80 is identical to motor 70.

SOFTWARE ORGANIZATION

Being a microprocessor-controlled system, practically all functions performed by the machine are carried out by the microprocessor's execution of a program of computer instructions. What follows is an explanation of the various routines and subroutines executed by the system in carrying out the overall control functions. Because the detailed machine coding would vary, depending upon the particular microprocessor employed, it is deemed unnecessary to present such machine coding herein. Instead, detailed flow diagrams of the main routines and all subroutines are set out in the drawings and an explanation thereof will be given. A person skilled in the art having the flow charts and explanation would be in a position to write machine code for a microprocessor whereby the various control functions can be accomplished.

Figure 3A:
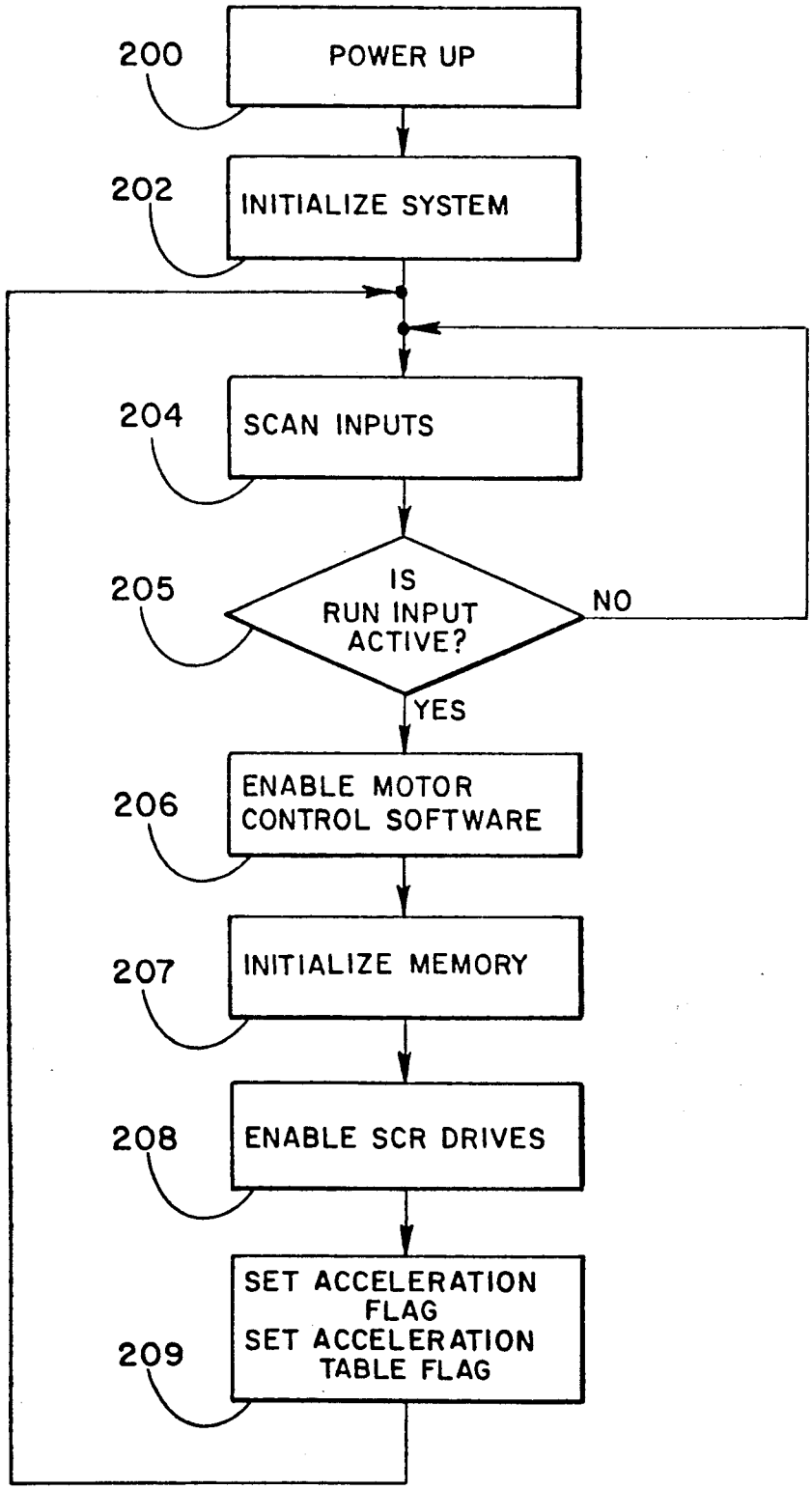
FIGS. 3A, 3B and 3C illustrate a flow diagram detailing the operating software of the present invention.

Referring to FIG. 3A, a detailed description of the algorithm will be provided in conjunction with referring to FIGS. 1 and 2. Upon power-up at step 200, the microprocessor 92 executes initialization step 202 whereby encoder counters of encoders 64 and 74 are cleared, the outputs of digital analog converter 94 are manually set to a digital zero value, RAM memory is zeroed, relays 120, 124 and 126 are disabled such that the respective drives 62, 72 and 82 output a zero DC voltage to respective motors 60, 70 and 80, thus disabling them. Next, step 204 is executed wherein input switches 150 which also include a "run input" are scanned to determine if the "run input" is active to enable the system. If the "run input" is not enabled, the software continues to scan input switches 150 at step 204 until a "run input" is sensed as active. When the "run input" is determined to be active, the motor control software is enabled at step 206. At step 207, the memory is initialized. Next, at step 208, SCR drives 62, 72 and 82 are enabled by enabling respective relays 120, 124 and 130. Next, at step 209, a first flag known as an "acceleration flag" is set, wherein an "acceleration table flag" is also set. Finally, the algorithm returns back to step 204 wherein the inputs are scanned once again in a repetitive fashion until an interrupt is generated by microprocessor 92.

Figure 3B:
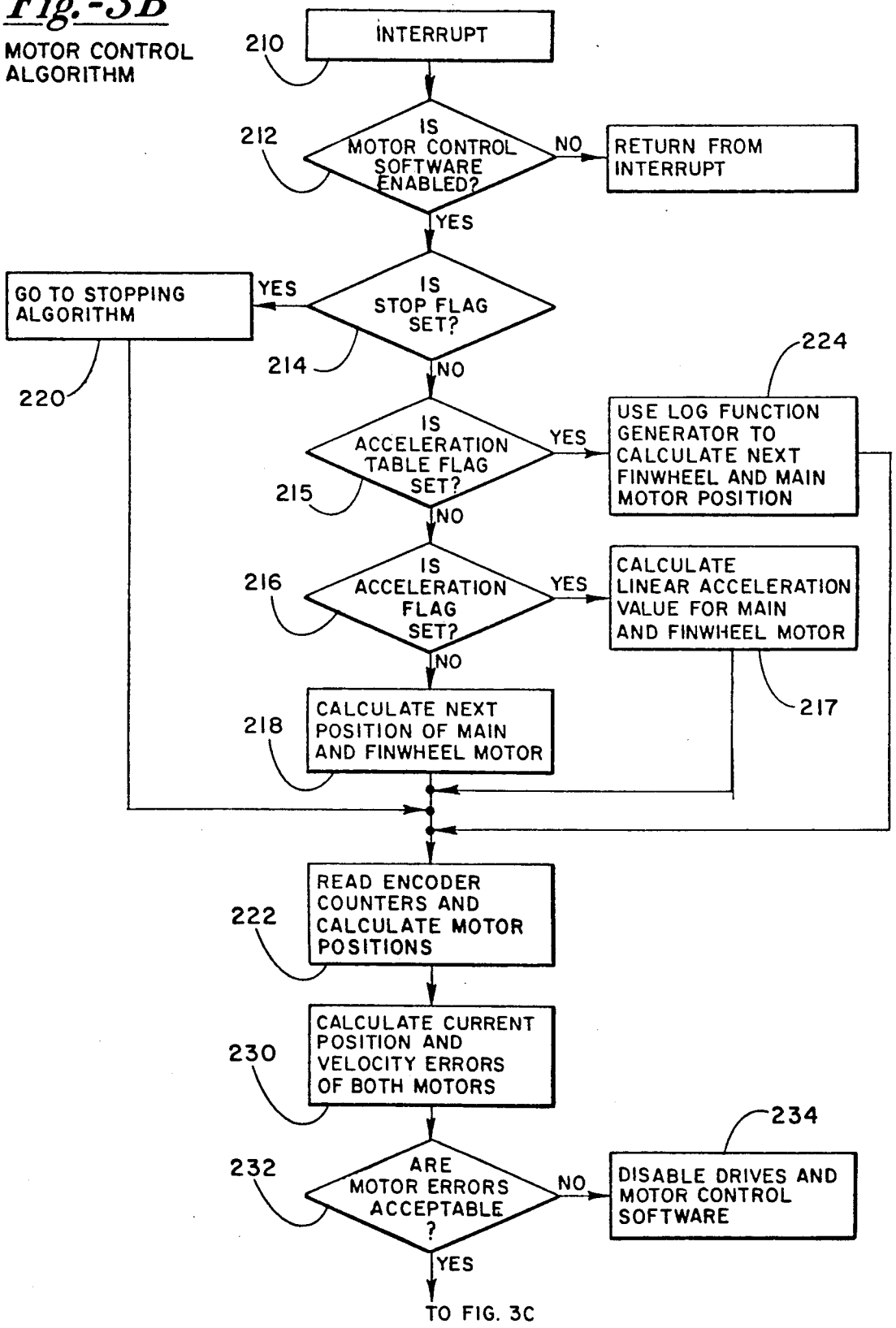

A detailed description of the motor control software which is enabled in step 206 will now be discussed in detail. Referring to FIG. 3B, microprocessor 92 periodically generates an interrupt at step 210 wherein step 212 is subsequently executed to determine if the motor control software was enabled in step 206. If the motor control software has not been enabled, the routine immediately returns from the interrupt. If during the interrupt at step 212 the motor control software has been enabled at step 206, step 214 is executed to determine if the "stop flag" has been set. If so, step 220 is executed wherein the routine branches to the stopping algorithm illustrated in FIG. 4 and which will be described shortly. Upon completing the stepping algorithm, the routine proceeds to step 222. If the "stop flag" has not been set at step 214, step 215 is performed to determine if the "acceleration table flag" has been set. If the answer is no, step 216 is performed to determine if the "acceleration flag" has been set. If not, the routine proceeds to step 218 to calculate the next position desired of the main motor 60 and the finwheel motor 70, and the routine proceeds to step 222. If the "acceleration flag" has been set at step 216, then step 217 is performed to calculate the linear acceleration value for the main and finwheel motor, and then the routine proceeds to step 222. If at step 215 the "acceleration table flag" has been set, the routine uses a log function generator at step 224 to calculate the next finwheel motor 70 and main motor 60 position which is desired to be obtained before the next interrupt is generated. Next, the routine proceeds from step 224 to step 222.

Figure 3C:
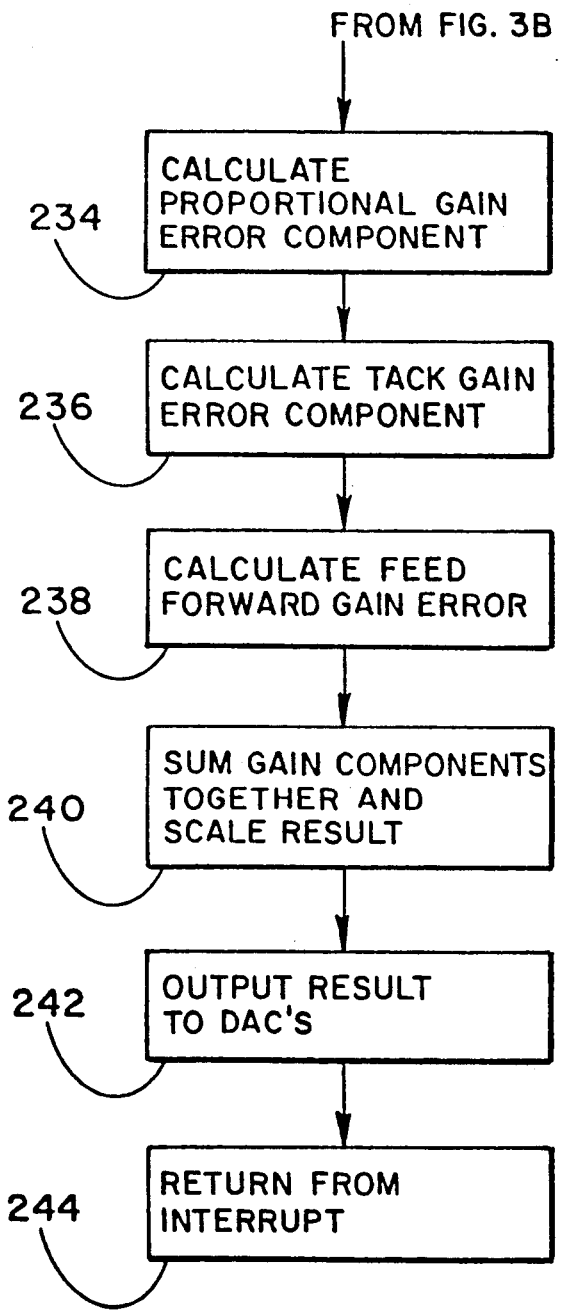

At step 222, the microprocessor reads the signals provided on input lines 114 and lines 115 which are generated by encoders 64 and 74, respectively, which provide a digital output signal indicative of the respective motor positions 60 and 70. Next, at step 230, the current position and velocity errors of both main motor 60 and finwheel motor 70 are determined by comparing the current positions of the motors determined in step 222 to the instructed positions established in step 218. Next, at step 232, the speed errors of motors 60 and 70 between the desired and actual speeds are compared to see if they are acceptable in relation to a predetermined tolerable error margin. If the errors are unacceptable, step 234 is executed wherein SCR drives 62, 72, and 82 are disabled, and the motor control software is disabled. If at step 232 the motor errors are acceptable, the routine proceeds to step 234 as illustrated in FIG. 3C.

At step 234, the proportional gain error component of each motor is calculated. Next, step 236 is executed wherein the tach gain error component of each motor is determined by multiplying the observed velocity of the each of the motors by the gain of the respective SCR drive. Next, at step 238, the feed forward gain error is determined for each motor which is required to adjust the true speed of the respective motor 60 and 70 to equal the desired speed. Next, at step 240, the gain errors calculated in steps 234, 236 and 238 are summed and the result is scaled into twelve bits and provided to the digital-to-analog converter 94 at step 242. At step 242, the digital analog converter 94 provides a new output on control lines 100 and 150 to respective SCR drives 62 and 72 to adjust the speed of motors 60 and 70 as necessary. Finally, the motor control algorithm returns from the interrupt at step 244 and the microprocessor turns back to step 204 as illustrated in FIG. 3A.

Figure 4:
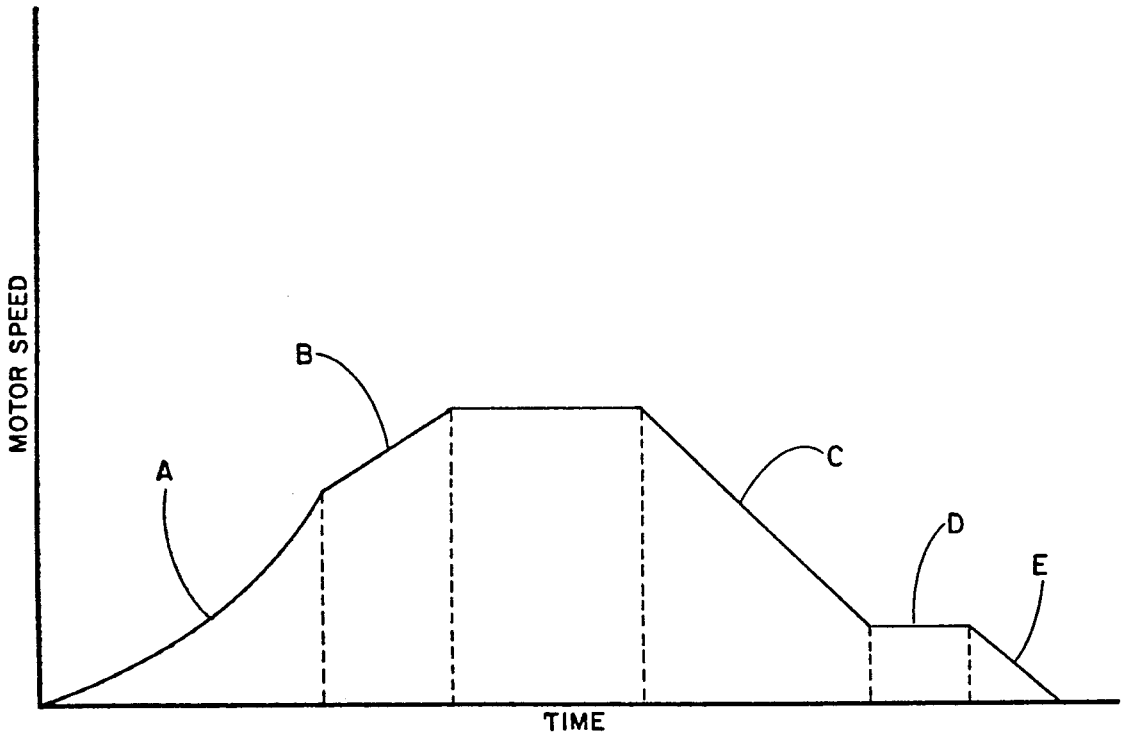
FIG. 4 is a graphical illustration of the acceleration and deceleration of the main and finwheel permanent magnet motors during initial start-up procedures, and during a standard shut-down condition.

FIG. 4 shows the acceleration and deceleration curves of both motors 60 and 70. When motors 60 and 70 are accelerated from rest, the analog signal provided by D/A converter 94 to SCR drives 62 and 72, via control lines 100 and 150, is non-linear as indicated by segment A. Since SCR wound permanent magnet motors driven by SCR drives have a "sluggish response" during acceleration, it has been empirically found that logarithmic acceleration curve is more appropriate to ensure that the respective motor can accelerate at a rate commanded by the microprocessor 92 without falling behind.

During normal operation, if either motor 60 or 70 needs to be accelerated to compensate for any detected speed errors, or if the machine is commanded at the input switches 150 to increase its speed, a linear acceleration command or output can be provided on control lines 100 and 150 as illustrated by segment B. As shown in segment C, if motor 60 or 70 are desired to be slowed down, they are slowed down linearly so that the inertia of the motors does not attempt to maintain a motor speed greater than the commanded speed during the deceleration process. During deceleration segment D, the motors maintain a "creep" speed for a short period of time, such as one-half a second, to ensure that motors 60 and 70 are both still in synchronism with each other. Finally, deceleration segment E illustrates that motor 60 and 70 and finally brought to a complete halt at a linear rate. Then, microprocessor 92 waits a predetermined amount of time, such as one-half a second, before disabling each SCR drive 62 and 72 to subsequently disable motors 60 and 70. This waiting period ensures motors 60 and 70 are at a complete halt and ensures cutting heads 24 and 26 come to rest in an open position, i.e., they are not in contact with the film.

Figure 5:
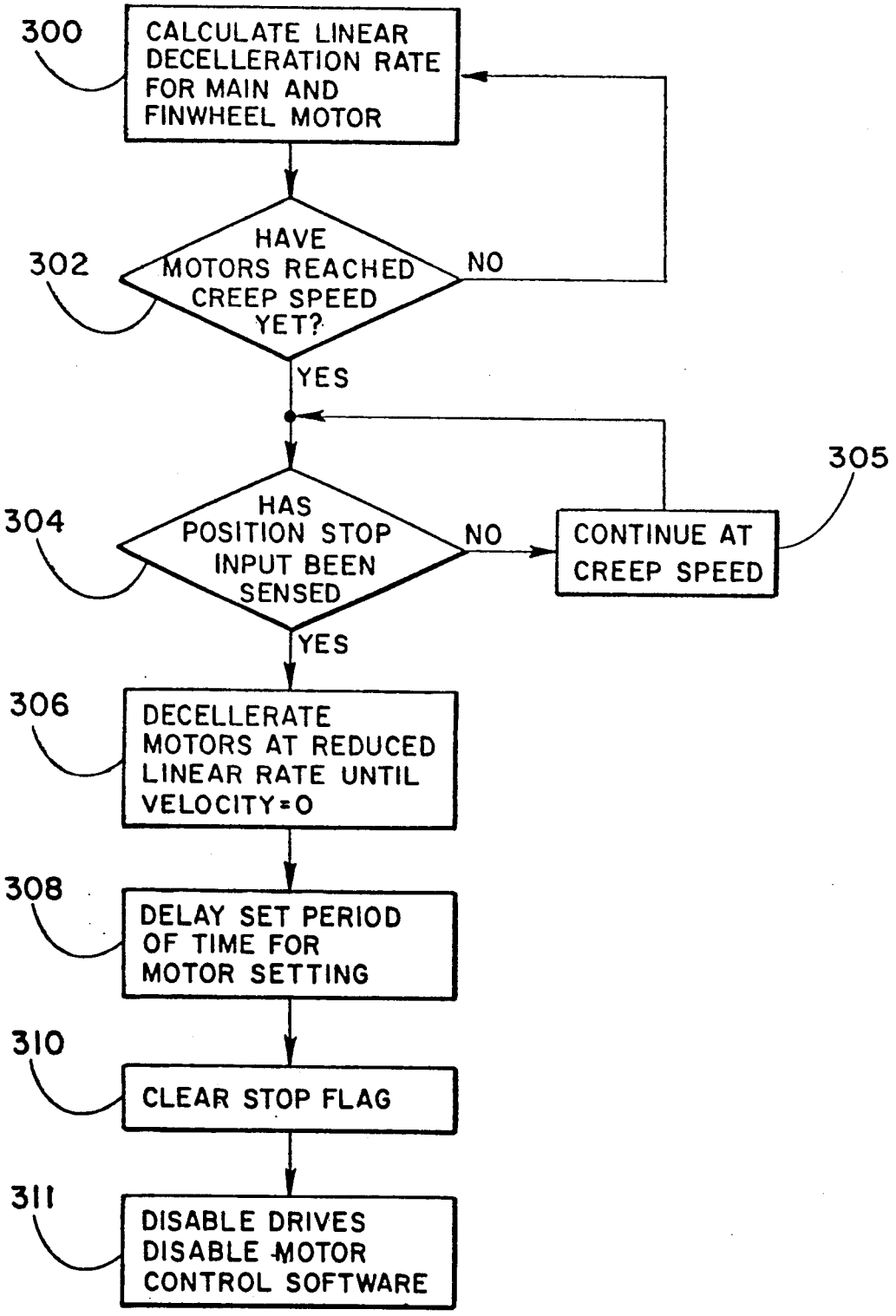
FIG. 5 illustrates a flow diagram of a stopping routine illustrated in FIG. 4.

Referring to FIG. 5, the stopping algorithm will now be described in detail. At step 300, the linear deceleration rate of the cutting head motor 60 and the finwheel motor 70 is determined by microprocessor 92. Next, at step 302, the algorithm determines if motors 60 and 70 have reached a "creep speed" yet, as illustrated by phase D in FIG. 4. If the motors have not reached their creep speed, the routine returns to step 300. Once the motors have reached a creep speed in step 302, step 304 is executed wherein a determination is made if the "position stop input" has been sensed yet. If not, step 305 is executed wherein the motors continue at a creep speed. Once the position stop input has been sensed in step 304, then step 306 is executed wherein motors 60 and 70 are decelerated at a linear rate as illustrated by phase E in FIG. 4 until the velocity of each motor 60 and 70 equals zero. Next, step 308 is executed wherein the microprocessor 92 waits a predetermined delay period to allow for motor settling. Finally, at step 310, the "stop flag" is cleared, SCR drives 62 and 72 are disabled and the motor control software illustrated in FIGS. 3A and 3B is also terminated.

In summary, the velocity of both main motor 60, which drives both infeed conveyor and the cutting head assembly 22, as well as the finwheel motor 70, are independent controlled by the microprocessor 92. Each motor is driven by an SCR drive which is responsive to the commands from the microprocessor via the D/A converter to establish the operating speed of the respective motor. An incremental optical encoder is adapted to each of the motors to provide a feedback signal to the microprocessor such that the microprocessor senses the true operating speed of the motors. The microprocessor compensates for speed errors by adjusting each of the motors independently.

The combination of an SCR drive, an SCR wound permanent magnet motor and an optical encoder providing feedback is an inexpensive combination relative to the cost of a servo amplifier and servo DC motor. Further, the wrapping machine of the present invention has easy product changeover and accurate control of package lengths, wherein the position of the motors can be precisely controlled as well. While the start-up and the slow-down time periods of the present invention are slower than a servo-controlled wrapping machine, since most machines are run continuously the price savings realized from the present invention is a desirable attribute to be considered by the cost-conscious business person.

This invention has been described in this application in considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications, both as to equipment details and operating procedures, can be accomplished without departing from the scope of the invention itself.

What is claimed is:

1. A horizontal wrapping machine for wrapping products in packages formed from a continuous film of packaging material comprising:

(a) a former for shaping a continuous film of packaging material drawn past the former into a continuous tube;

(b) film drive means, responsive to a film drive rate control signal, for drawing the continuous film of packaging material past the former and past a cutting and sealing station at a velocity dependent upon the film drive rate control signal, said film drive means comprising a first SCR drive receiving the film drive rate control signal and a first permanent magnet motor coupled and responsive to the first SCR drive;

(c) film drive sensing means for sensing the film drive means and providing a first output indicative of a position of the drive means;

(d) cutting head means, responsive to a product flow rate control signal, for cutting and sealing products to be packaged at a rate dependent upon the product flow rate control signal;

(e) cutting head sensing means for sensing the cutting head means and providing a second output indicative of a position of the cutting head means;

(f) means for feeding products to be packaged into the former and the continuous tube of packaging material as a function of the cutting head means;

(g) input means for providing input signals defining a desired product flow rate for said wrapping machine; and (h) microprocessor means responsive to the signal from said input means and including a click means, the microprocessor means providing the film drive rate control signal as a function of the clock means, the input means and the first output, the microprocessor means providing the product flow rate control signal as a function of the clock means, the input means and the second output.

2. The wrapping machine as specified in claim 1 wherein the clock means operates at a fixed frequency.

3. The wrapping machine as specified in claim 2 further comprising:

(a) film position sensing means for developing a first digital output indicative of the instantaneous position of the film relative to a predetermined reference;

(b) cutting head position sensing means for developing a second digital output indicative of the instantaneous position of the cutting and sealing station; and (c) wherein the microprocessor means adjusts the film drive rate control signal as a function of the first and second digital outputs to adjust the velocity of the film drive means to coordinate the position of the cutting and sealing station with the position of the film.

4. The wrapping machine as specified in claim 2 wherein said clock means comprises an oscillator.

5. The wrapping machine as specified in claim 1 wherein the product flow means comprises:

(a) a second SCR device receiving the product flow rate control signal; and (b) a second permanent magnet motor coupled and responsive to the second SCR drive.

6. The wrapping machine as specified in claim 5 wherein the film drive sensing means and the product flow sensing means each comprise an encoder means for sensing the position of the respective motor.

7. The wrapping machine as specified in claim 6 wherein each of the encoder means comprises an incremental optical encoder providing the respective first and second output to the microprocessor means, wherein the microprocessor means computes the velocity of the first and second permanent magnet motors as a function of the respective first and second output signal and the clock means.

8. The wrapping machine as specified in claim 1 wherein the film drive rate control signal and the product flow rate control signal are non-linear over time when the film drive means and the product infeed means are accelerated to an operating velocity such that the velocity of the film drive means and the cutting head means remain proportional to one another during acceleration.

9. The wrapping machine as specified in claim 8 further comprising a discharge means for removing packages from the cutting and sealing station.

10. The wrapping machine as specified in claim 1 wherein the film drive means comprises at least one pair of finwheels wherein at least one finwheel is heated.

11. A horizontal wrapping machine for wrapping products in packages formed from a continuous film of packaging material, comprising:

(a) a former for shaping a continuous film of packaging material drawn past the former into a continuous tube;

(b) film drive means, responsive to a variable analog film drive rate control signal, for drawing the continuous film of packaging material past the former and past a cutting and sealing station at a velocity dependent upon the film drive rate control signal;

(c) film drive sensing means for sensing the film drive means and providing a first output indicative of a position of the drive means;

(d) cutting head means, responsive to a product flow rate control signal, for cutting and sealing products to be packaged at a rate dependent upon the product flow rate control signal;

(e) cutting head sensing means for sensing the cutting head means and providing a second output indicative of a position of the cutting head means;

(f) means for feeding products to be packaged into the former and the continuous tube of packaging material as a function of the cutting head means;

(g) input means for providing input signals defining a desired product flow rate for said wrapping machine; and (h) microprocessor means responsive to the signal from said input means and including a clock means, the microprocessor means providing the analog film drive rate control signal as a function of the clock means, the input means and the first output, the microprocessor means providing the product flow rate control signal as a function of the clock means, the input means and the second output.

12. The wrapping machine as specified in claim 11 wherein said clock means comprises an oscillator.

13. The wrapping machine as specified in claim 12 wherein the clock means operates at a fixed frequency.

14. The wrapping machine as specified in claim 12 further comprising:

(a) film position sensing means for developing a first digital output indicative of the instantaneous position of the film relative to a predetermined reference;

(b) cutting head position sensing means for developing a second digital output indicative of the instantaneous position of the cutting and sealing station; and (c) wherein the microprocessor means adjusts the film drive rate control signal as a function of the first and second digital outputs to adjust the velocity of the film drive means to coordinate the position of the cutting and sealing station with the position of the film.

15. The wrapping machine as specified in claim 12 wherein the film drive rate control signal and the product flow rate control signal are non-linear over time when the film drive means and the product infeed means are accelerated to an operating velocity such that the velocity of the film drive means and the cutting head means remain proportional to one another during acceleration.

16. The wrapping machine as specified in claim 12 wherein the film said drive means comprises at least one pair of finwheels wherein at least one finwheel is heated.

* * * * *

UNITED STATES PATENT AND TRADEMARK OFFICE

CERTIFICATE OF CORRECTION

PATENT NO. : 5,138,815

DATED : August 18, 1992

INVENTOR(S) : Paul L. Groschen, Jr.

It is certified that error appears in the above-identified patent and that said Letters Patent is hereby corrected as shown below:

Column 12, Line 8, delete the word "click" and replace it with -- clock --.

Signed and Sealed this

Thirty-first Day of August, 1993

*Attest:*

Bruce Lehman

BRUCE LEHMAN

*Attesting Officer*

*Commissioner of Patents and Trademarks*